US005216951A

United States Patent [19]

Yokoyama et al.

[11] Patent Number: 5,216,951

[45] Date of Patent: Jun. 8, 1993

[54] THERMAL PLATE MAKING APPARATUS

[75] Inventors: Yasumitsu Yokoyama, Kakuda; Mitsuo Sato, Miyagi, both of Japan

[73] Assignee: Ricoh Company, Ltd., Tokyo, Japan

[21] Appl. No.: 968,452

[22] Filed: Oct. 29, 1992

Related U.S. Application Data

[63] Continuation of Ser. No. 713,080, Jun. 11, 1991.

[30] Foreign Application Priority Data

Jun. 14, 1990 [JP] Japan ..... 2-155734

[51] Int. Cl.[5] ..... B41J 2/335

[52] U.S. Cl. ..... 101/128.4; 346/76 PH; 400/120

[58] Field of Search ..... 101/128.4, 467; 346/76 PH; 400/120; 250/316.1

[56] References Cited

U.S. PATENT DOCUMENTS

| | | | |
|---|---|---|---|
| 4,957,378 | 9/1990 | Shima | 400/120 |
| 5,021,806 | 6/1991 | Sugiyama | 346/76 PH |
| 5,045,866 | 9/1991 | Chiba | 346/76 PH |
| 5,053,792 | 10/1991 | Une | 346/146 |
| 5,105,203 | 4/1992 | Kuwabara | 400/120 X |
| 5,157,414 | 10/1992 | Seino | 346/76 PH |

FOREIGN PATENT DOCUMENTS

| | | | |
|---|---|---|---|
| 146786 | 11/1981 | Japan | 400/120 |
| 155075 | 9/1984 | Japan | 400/120 |
| 48398 | 3/1985 | Japan | 101/128.4 |
| 199656 | 10/1985 | Japan | 101/128.4 |
| 208244 | 10/1985 | Japan | 101/128.4 |
| 236755 | 11/1985 | Japan | 101/128.4 |
| 58555 | 3/1988 | Japan | 400/120 |
| 221056 | 9/1988 | Japan | 400/120 |
| 237963 | 10/1988 | Japan | 400/120 |
| 114785 | 5/1991 | Japan | 101/128.4 |

*Primary Examiner*—Edgar S. Burr
*Assistant Examiner*—Eric P. Raciti
*Attorney, Agent, or Firm*—Oblon, Spivak, McClelland, Maier & Neustadt

[57] ABSTRACT

A thermal plate making apparatus including a thermal head having a plurality of heating elements arranged in a line. Each element has a shape having substantially four corners. And a protruding portion for enhancing heat generation is formed at each of at least two diagonal corners of the element.

5 Claims, 10 Drawing Sheets

THERMAL PLATE MAKING APPARATUS

This application is a continuation of application Ser. No. 07/713,080, filed on Jun. 11, 1991, now abandoned.

BACKGROUND OF THE INVENTION

1. Field of the Invention

The present invention relates to a thermal plate making apparatus for forming a stencil paper to be mimeographed of a stencil duplicator by scanning and heating a thermosensitive film by a line thermal head to make holes of dots in the film.

2. Description of the Related Art

A thermal plate making apparatus comprises a platen roller and a line thermal head between which a thermosensitive sheet of stencil paper passes through. The paper is selectively heated by heating elements of the thermal head which scans the paper in the horizontal direction while the paper is conveyed in the vertical direction so that holes are formed in the paper, whereby a stencil paper of a mimeographing machine is produced.

More precisely, in such a thermal plate making apparatus, the line thermal head comprises a plurality of rectangular heating elements disposed side by side in parallel to each other along a main scanning direction, i.e., horizontal scanning direction. Conductive wiring patterns are disposed in both longitudinal ends of each heating element along a sub-scanning direction, i.e., vertical direction electrically contacting with the heating element.

If resolution of the apparatus is 16 dpi, each heating element is formed in such a rectangular shape that the length in the vertical scanning direction is about 80 to 120 μm and the length in the horizontal scanning direction is about 40 to 55 μm, the elements being arranged at a pitch of 62.5 μm along the horizontal scanning direction.

Such a line thermal head is also used as a head of a thermal printer and arranged in such a manner that the paper is fed at a pitch of 62.5 μm in the vertical scanning direction, that is the same as the horizontal scanning direction. Therefore, if a stencil paper is scanned and heated by the line thermal head, two adjacent dots (holes) for passing through an ink become continuous because each boundary portion between the dots is destroyed. If papers are printed with the use of such a stencil, an overly large amount of ink passes through the continuous holes of the stencil so that the ink of the printed paper stains the back side of the preceding or subsequent printed paper when the printed papers are stacked one above the other.

In order to obviate such a problem, a thermal plate making apparatus is proposed in Japanese Patent Application Laying Open (KOKAI) No. 2-67133. In the proposed apparatus, the line thermal head comprises a plurality of heating elements, the length of each element in the vertical scanning direction being shorter than the pitch of the element arrangement in the horizontal scanning direction. For example, the length of the element is about 60 μm along the vertical scanning direction and the elements are disposed at a pitch of 62.5 μm in the horizontal scanning direction.

In accordance with such an arrangement, the thermal energy generated from each heating element is reduced, which enables the device to reliably form individual ink holes independently from the adjacent holes interposing a predetermined boundary space therebetween.

Therefore, the line thermal head mentioned above makes it possible to produce a stencil paper for a mimeographing machine in which the problem that the back side of the printed paper is stained by ink is attenuated.

In accordance with the above-mentioned thermal head structure, the rectangular heating element has four corners from which heat is effectively transferred and radiated to the outside thereof so that the temperature of the corners is reduced. Therefore, the ink hole formed by the heating element is rounded rather than rectangular.

Accordingly, a large blank space is formed at a center portion surrounded by four rounded ink holes in the stencil so that when the stencil is used for printing a paper, a white blank is formed in a portion where the ink is to be printed all black.

Besides, a problem arises in connection with the temperature distribution in the heating element of the line thermal head mentioned above as described hereinafter.

With respect to the long element having a length 85 to 120 μm in the vertical scanning direction, the temperature changing range is small, that is, the temperature of the element does not change much in the longitudinal direction thereof and the peak temperature is relatively low. On the other hand, with respect to the short element having a length about 60 μm in the vertical scanning direction, the temperature changing range is large, that is, the temperature of the element changes remarkably in the vertical scanning direction and the peak temperature is high. Therefore, when the temperature of the element is fluctuated, since the temperature changing range of the short element is wide in comparison to the long element, it becomes difficult to evenly form ink holes in the stencil paper with the use of the short elements which are used in the line thermal head to obviate the problem of staining the printed paper by the ink.

Besides, the durability of each element is dependent on the peak temperature of the element, therefore, the service life of the short element is shortened. That is, as the length of the element in the vertical scanning direction is shortened, the unevenness of the resistance of the element becomes large so that the temperature changing range becomes large. Accordingly, the peak temperature becomes large, which shortens the life of the apparatus.

SUMMARY OF THE INVENTION

The present invention was made considering the above-mentioned problems of the related art.

It is therefore an object of the present invention to provide a thermal plate making apparatus which makes it possible to produce a stencil having ink holes evenly formed in the stencil and raise the durability of the apparatus.

The above-mentioned object of the present invention can be achieved by a thermal plate making apparatus comprising a thermal head that comprises a plurality of heating elements arranged in a line, each element having a shape having substantially four corners, and at least one protruding portion protruding in a predetermined direction for enhancing heat generation corners of the element.

More precisely, the thermal plate making apparatus of the present invention comprises a line thermal head comprising a plurality of substantially rectangular heating elements disposed side by side in parallel to each other along the horizontal scanning direction, a wiring pattern being connected to each end of the element in the vertical scanning direction, a stencil being supported abutting to the thermal head so that the stencil is movable in the vertical scanning direction in relation to the thermal head which heats the stencil to form ink holes therein, in which the length of each heating element in the vertical scanning direction is longer than the pitch of the elements in the horizontal scanning direction and in which a pixel shaping portion is arranged at least one diagonal corner of the rectangular element which portion projects outward from the element.

In accordance with the structure mentioned above, the four corners of the heating element are heated by the outwardly projecting portions formed at the corners thereof so that the ink hole formed in the stencil by the element becomes substantially rectangular, which reduces the blank portion formed at a center surrounded by four holes in the stencil.

Therefore, it is an advantage of the present invention that the white blank is not generated in the portion where the paper is to be printed black, which upgrades the quality of the print.

Besides, the length of the heating element in the vertical scanning direction is long, which makes it possible to reduce the temperature change in this direction as a result of which unevenness of the hole size formed by the element is minimized.

Therefore, it is another advantage of the present invention that it becomes possible to produce stencils evenly having a constant quality of high grade.

It is still another advantage of the present invention that the durability of the heating element is raised since the length of the element in the vertical scanning direction is long, which elongates the life of the apparatus.

A further advantage of the present invention is that due to an arrangement of heat concentration on the center of the heating element, the individual ink holes can be reliably formed independently from each other separated by boundary space reliably formed therebetween, which enables to avoid staining of the printed paper by the ink.

Further objects and advantages of the present invention will be apparent from the following description of the preferred embodiments of the present invention as illustrated in the accompanying drawings.

DESCRIPTION OF THE PREFERRED EMBODIMENTS

Figure 1:
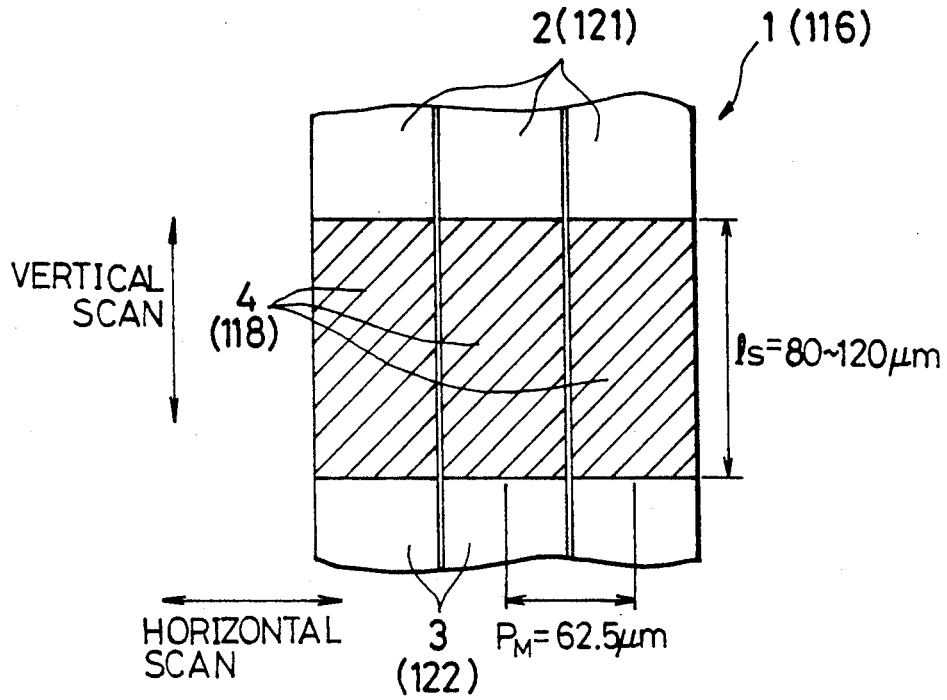
Fig. 1 PRIOR ART
FIG. 1 is a plan view of an example of a conventional line thermal head.

Embodiments of the present invention are described hereinafter with reference to the drawings in comparison to the related art which is also described referring to the drawings.

A conventional thermal plate making apparatus comprises, as illustrated in FIG. 1, a line thermal head 1 which comprises a plurality of rectangular heating elements 4 disposed side by side in parallel to each other along a main scanning direction, i.e., horizontal scanning direction. Conductive wiring patterns 2 and 3 are disposed in both longitudinal ends of each heating element 4 along a sub-scanning direction, i.e., vertical direction electrically contacting with the heating element 4.

If resolution of the apparatus is 16 dpi, each heating element 4 is formed in such a rectangular shape that the length in the vertical scanning direction is about 80 to 120 μm and the length in the horizontal scanning direction is about 40 to 55 μm, the elements being arranged at a pitch of 62.5 μm along the horizontal scanning direction.

Figure 2:
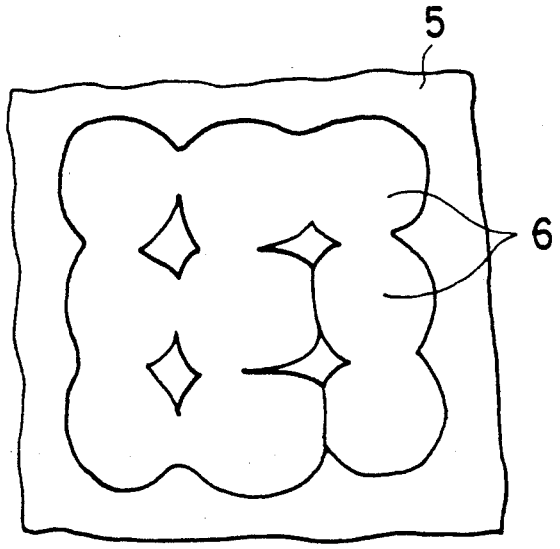
Fig. 2 PRIOR ART
FIG. 2 is a plan view of a stencil produced by the plate making apparatus using the thermal head of FIG. 1.

Such a line thermal head is also used as a head of a thermal printer in which the paper feeding is arranged in such a manner that the paper is fed at a pitch of 62.5 μm in the vertical scanning direction, that is the same as the horizontal scanning direction. Therefore, if a stencil paper is scanned and heated by the line thermal head, two adjacent dots (ink holes) 6 for passing through an ink become continuous because each boundary portion between the dots 6 is destroyed, as illustrated in FIG. 2. If papers are printed with the use of such a stencil 5, an overly large amount of ink passes through the continuous holes 6 of the stencil 5 so that the ink of the printed paper stains the back side of the preceding or subsequent printed paper when the printed papers are stacked one above the other.

Figure 3:
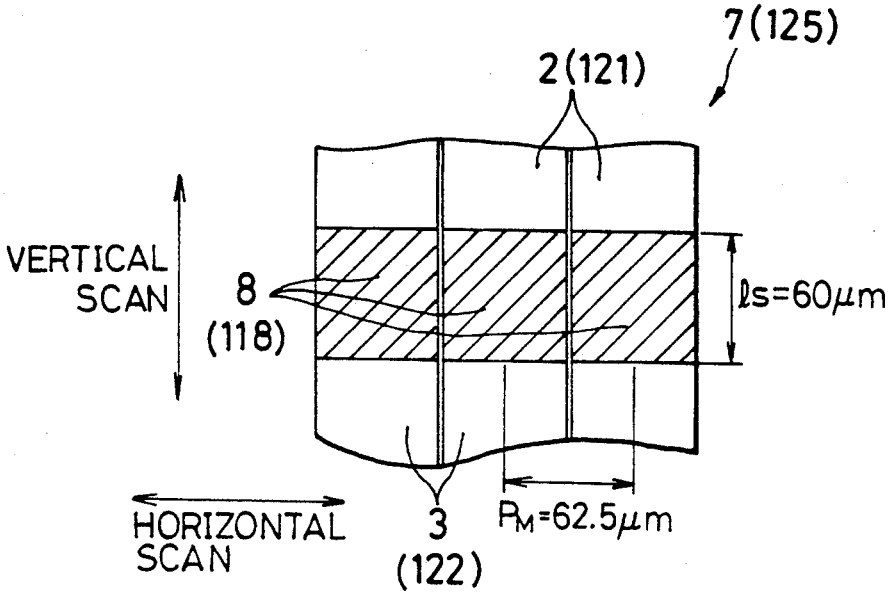
Fig. 3 PRIOR ART
FIG. 3 is a plan view of another example of a conventional line thermal head.

In order to obviate such a problem, an improved thermal plate making apparatus is proposed. In the proposed apparatus, as illustrated in FIG. 3, the line thermal head 7 comprises a plurality of heating elements 8, the length of each element in the vertical scanning direction being shorter than the pitch of the element arrangement in the horizontal scanning direction. For example, the length of the element is about 60 μm along the vertical scanning direction and the elements are disposed at a pitch of 62.5 μm in the horizontal scanning direction.

Figure 4:
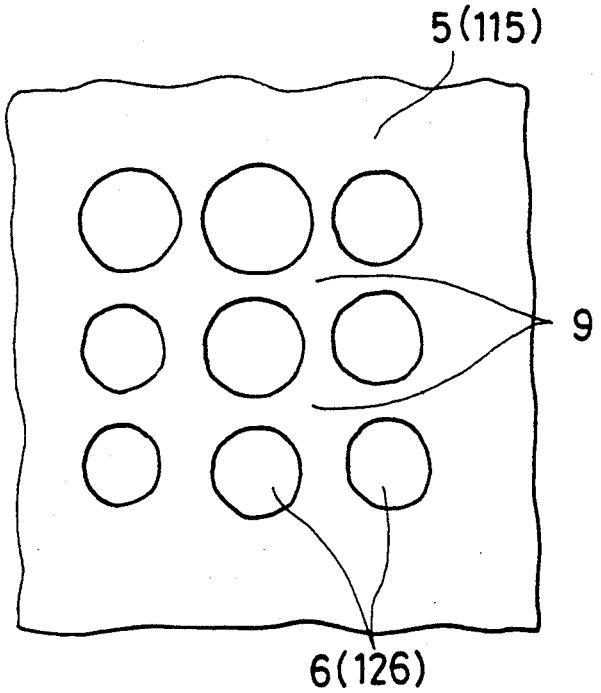
Fig. 4 PRIOR ART
FIG. 4 is a plan view of a stencil produced by the plate making apparatus using the thermal head of FIG. 3.

In accordance with such an arrangement, the thermal energy generated from each heating element 8 is reduced, which enables the device to reliably form individual ink holes 6 independently from the adjacent holes interposing a predetermined boundary space therebetween, as illustrated in FIG. 4.

Therefore, the line thermal head 7 mentioned above makes it possible to produce a stencil paper for a mimeographing machine in which the problem that the back side of the printed paper is stained by ink is attenuated.

In accordance with the above-mentioned thermal head structure, the rectangular heating element 8 has four corners from which heat is effectively transferred and radiated to the outside thereof so that the temperature of each corner is reduced. Therefore, the ink hole 6 formed by the heating element 8 is rounded rather than rectangular.

Accordingly, a large blank space 9 is formed at a center portion surrounded by four rounded holes 6 so that when the stencil 5 is used for printing a paper, a white blank is formed in a portion where the ink is to be printed all black.

Besides, a problem arises in connection with the temperature distribution in the heating element of the line thermal head mentioned above as described hereinafter.

Figure 5:
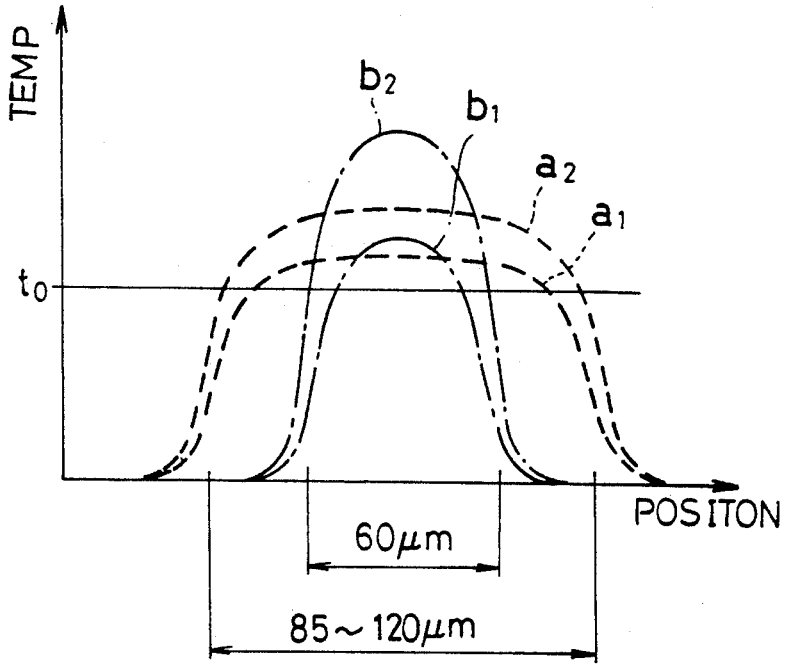
Fig. 5 PRIOR ART
FIG. 5 is a graphical view of characteristics of a conventional thermal head representing the temperature distribution thereof.

FIG. 5 illustrates a graph of thermal distribution characteristics of the heating elements 4 and 8 of the thermal head 1 and 7, in which the abscissa represents the position in the heating element along the vertical scanning direction and the ordinate represents the temperature at the position in the element. The temperature $t_0$ in the graph represents a critical temperature (or minimum temperature) for forming an ink hole 6 in the stencil 5 with the use of the heating element.

Dash lines $a_1$ and $a_2$ represent the temperature in the long element 4 while the dash-dot lines $b_1$ and $b_2$ represent the temperature in the short element 8. As can be seen from the graph, with respect to the long element 4 having a length 85 to 120 μm in the vertical scanning direction, the temperature changing range (i.e., range between the lines $a_1$ and $a_2$) is small, that is, the temperature of the element 4 does not change much in the longitudinal direction thereof and the peak temperature is relatively low. On the other hand, with respect to the short element 8 having a length about 60 μm in the vertical scanning direction, the temperature changing range (i.e., range between lines $b_1$ and $b_2$) is large, that is, the temperature of the element 8 changes remarkably in the vertical scanning direction and the peak temperature is high. Therefore, when the temperature of the element is fluctuated, since the temperature changing range of the short element 8 is wide in comparison to the long element 4, it becomes difficult to evenly form ink holes 6 in the stencil paper 5 with the use of the short elements 8 which are used in the line thermal head 7 to obviate the problem of staining the printed paper by the ink.

Besides, the durability of each element is dependent on the peak temperature of the element, therefore, the service life of the short element is shortened. That is, as the length of the element in the vertical scanning direction is shortened, the unevenness of the resistance of the element becomes large so that the temperature changing range becomes large. Accordingly, the peak temperature becomes large, which shortens the life of the apparatus.

The above-mentioned problems can be obviated by embodiments of the present invention described below with reference to FIGS. 6 to 14. The same or corresponding parts are designated by the same numerals as the structure of FIGS. 1 to 4.

Figure 8:
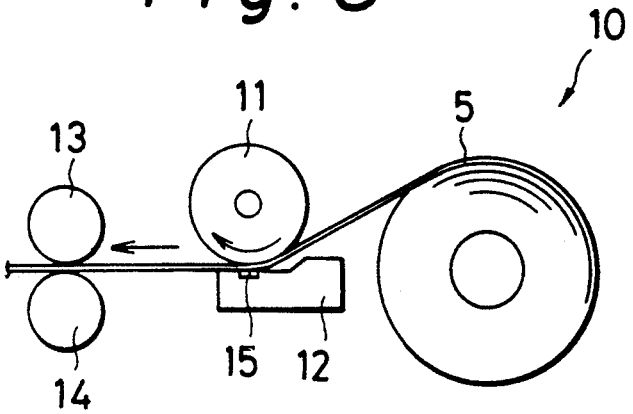
FIG. 8 is a side view of an example of the thermal plate making apparatus to which the present invention can be applied.

FIG. 8 illustrates a structure of a thermal plate making apparatus 10 to which the present invention is to be applied. The apparatus 10 comprises a platen roller 11 and a line thermal head 12. A stencil roll is rotatably supported so that a continuous strip of stencil sheet 5 is guided and passes between the platen 11 and the head 12. The stencil 5 is also guided between guide rollers 13 and 14.

Figure 6:
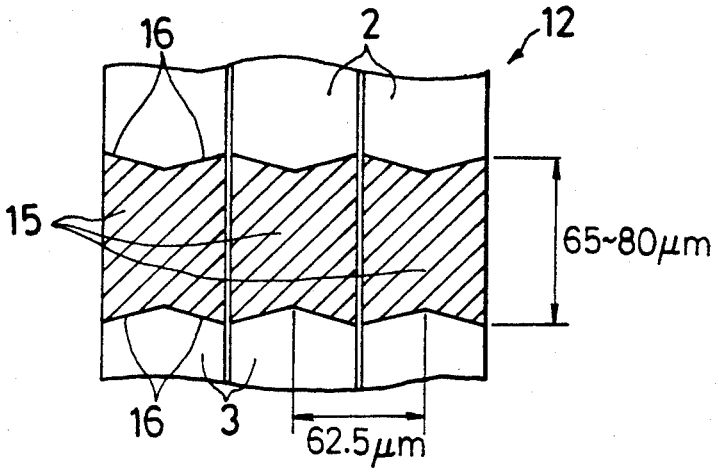
FIG. 6 is a plan view of an embodiment of the line thermal head in accordance with the present invention.

FIG. 6 illustrates a plan view of the thermal head 12. The head 12 comprises a plurality of heating elements 15. Each element 15 is substantially rectangular though each of four corners 16 is shaped as triangular to project outward in the vertical scanning direction to form a pixel shaping portion 16. The elements 15 are disposed at a pitch of 62.5 μm in the horizontal scanning direction. The length of the element 15 in the horizontal scanning direction is about 45 μm while the length in the vertical scanning direction is about 65 to 80 μm.

The apparatus 10 is used for producing stencils for a mimeographing duplicator by scanning and heating the stencil paper.

Figure 7:
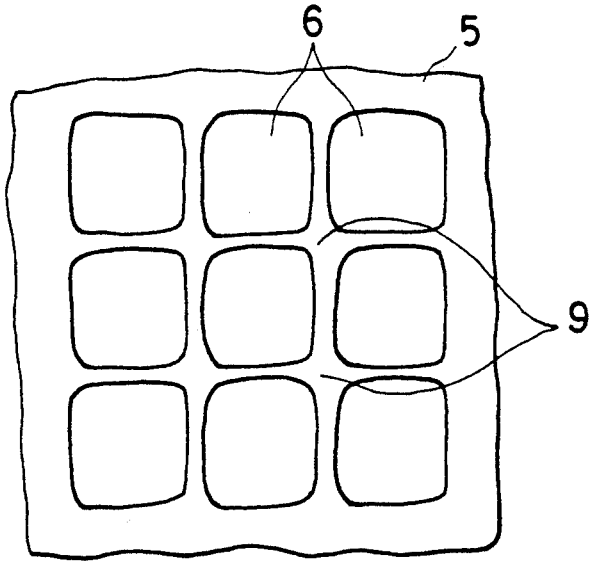
FIG. 7 is a plan view of a stencil produced by the plate making apparatus using the thermal head of FIG. 6.

In accordance with the apparatus 10, as illustrated in FIG. 6, each heating element 15 has the shaping portions 16 at four corners thereof, each portion 16 being projected in the vertical scanning direction. Therefore, when the stencil film is heated by the head 12, each of the ink holes 6 formed in the stencil 5 becomes substantially square, as illustrated in FIG. 7. This is due to the function of the projecting portions 16. That is, the portion 16 prevents the corner from being cooled and raises the temperature of the corner to the point needed to form the hole 6 in the stencil 5.

Accordingly, the blank portion 9 defined at the center surrounded by four ink holes 6 becomes narrow in comparison to the case of FIG. 4 so that the generation of white blank in the portion to be printed black is avoided, which upgrades the printing quality.

Besides, in accordance with the head 12 of the apparatus 10 of this embodiment, the length of the element 15 in the vertical scanning direction is longer than the pitch of the elements in the horizontal direction, which reduces the temperature change in the element along the vertical scanning direction. Therefore, it becomes possible to evenly form the ink holes 6 in the stencil 5 having uniform quality.

Further, due to the shape that the element 15 is long in the vertical scanning direction, the peak temperature is lowered, which raises the durability of the element so that the life of the head 12 is elongated.

Figure 9:
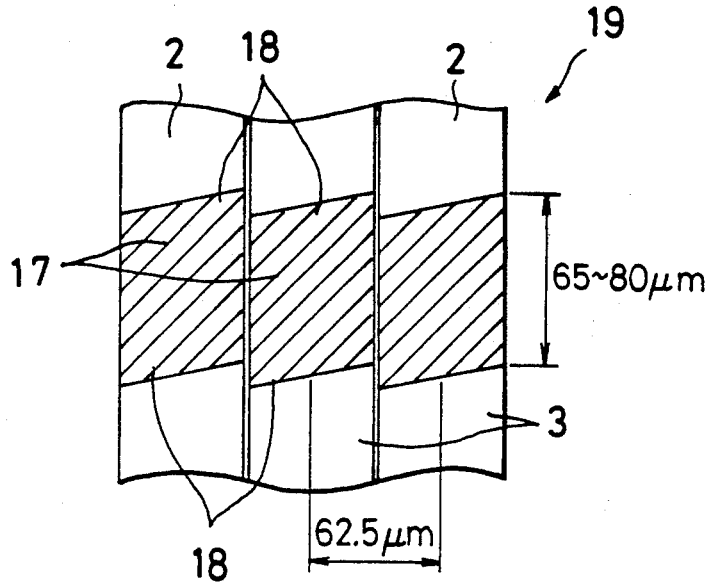
FIG. 9 is a plan view of a variant of the embodiment of the line thermal head of FIG. 6.

FIG. 9 illustrates another embodiment of the present invention.

In this embodiment, the line thermal head 19 comprises a heating element 17 which has protruding portions 18 at two diagonal corners of the rectangular element.

Figure 10:
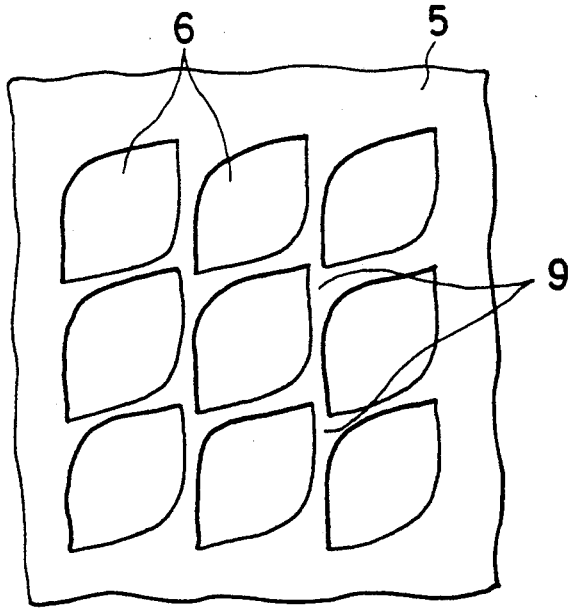
FIG. 10 is a plan view of a stencil produced by the plate making apparatus using the thermal head of FIG. 9.

FIG. 10 illustrates a stencil 5 produced with the use of the thermal head 19 of FIG. 9. Each center portion 9 at the center of each four holes 6 is also narrowed as in the case of the first embodiment of FIGS. 6 and 7, so that the printing quality of prints printed by the stencil 5 is heightened.

Figure 11:
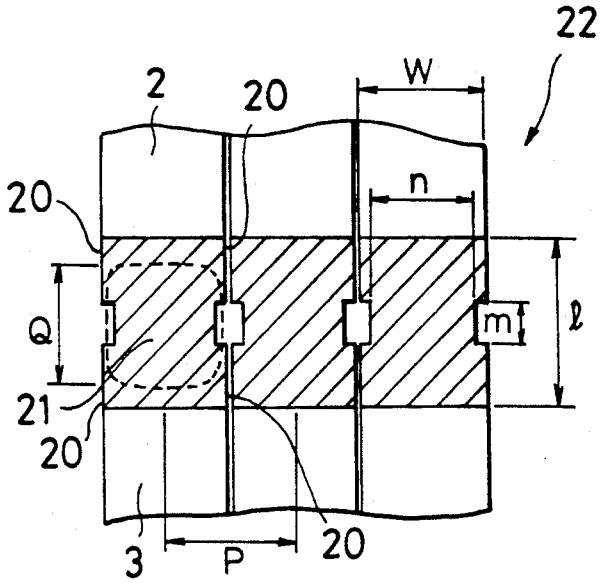
FIG. 11 is a plan view of another variant of the embodiment of the line thermal head of FIG. 6.

FIG. 11 illustrates still another embodiment of the present invention.

Figure 12:
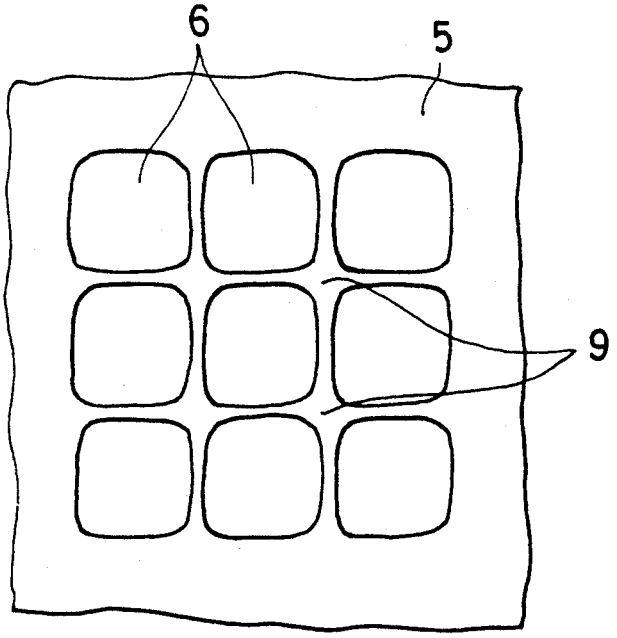
FIG. 12 is a plan view of a stencil produced by the plate making apparatus using the thermal head of FIG. 11.

In this embodiment, a protruding portion 20 is formed at each lateral end of each longitudinal end of the element 21 so that the element 21 is formed as an I-shape. The length l of the I-shaped element 21 in the vertical scanning direction is longer than the pitch P of the elements 21 in the horizontal scanning direction. The width n of the element 21 in the center portion thereof is smaller than the width W of the element 21 at the end thereof. Therefore, the heat generated from the element 21 is concentrated to the center portion of length m of the element 21. Also, the four corners of the element 21 are heated highly by the protruding portions 20 as well as the center portion thereof. Therefore, the ink hole 6 formed by each element 21 becomes substantially square, as illustrated in FIG. 12, which makes it possible to raise the print quality.

Besides, the center portion of the element 21 is spaced from those of the adjacent elements 21, which attenuates the thermal influence from the adjacent elements and reduces the heat accumulation in the horizontal scanning direction. As a result, it becomes possible to raise the operation speed of the thermal head.

Further, due to the protruding portions 20 formed at the ends of the element 21, the heat accumulation amount is increased in the vertical scanning direction. Therefore, it becomes possible to quickly raise the temperature and raise the efficiency of heat generation.

The concrete dimensions of the element 21 is, for example, as follows.

The pitch P of the elements is $P=62.5$ μm. The length l of the whole element in the vertical scanning direction is $l=70-120$ μm. The width W of the protruding portion in the horizontal direction is $W=45$ μm. The width n of the center portion of the element is $n=30-40$ μm. And the length m of the center portion of the element along the vertical direction is $m=40-60$ μm.

Also, the length Q of the area of the element 21 corresponding to the ink hole 6 formed by the element 21 in the stencil 5 is smaller than the scanning pitch of the stencil 5 in the vertical scanning direction due to the heat concentration due to the featured shape of the element. As a result, the ink holes 6 are formed independently from each other without being combined together, which upgrades the printing quality of the stencil.

Figure 13:
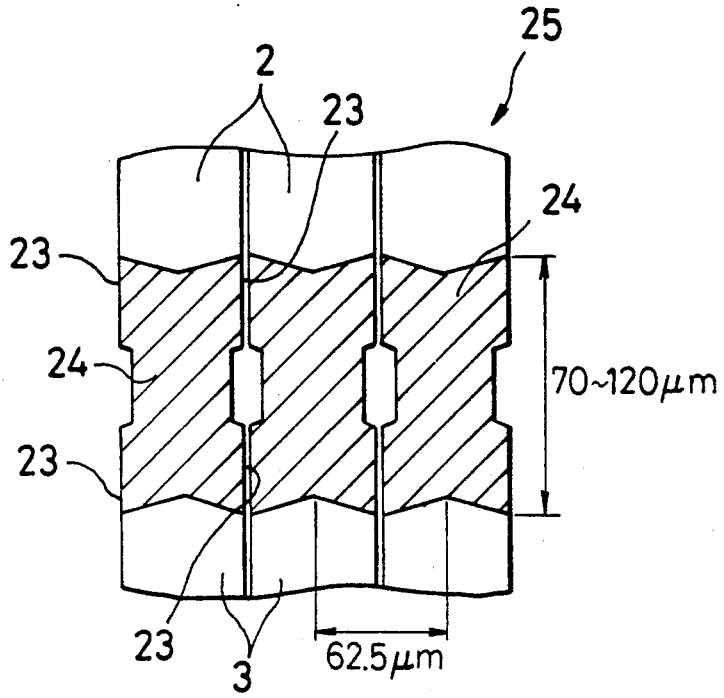
FIG. 13 is a plan view of still another variant of the embodiment of the line thermal head of FIG. 6.

FIG. 13 illustrates a further embodiment of the present invention.

In this embodiment, not only the heating element 24 has protruding portions 23 at each end along the vertical scanning direction but also the center portion of the element is narrowed. That is, the embodiment of FIG. 13 is substantially the combination of the embodiments of FIGS. 6 and 11. Namely, the heating element 24 of the thermal head 25 has the corner portions 23 each functioning as the triangular portion 16 of the element 15 of FIG. 6 as well as the protruding portion 20 of the element 21 of FIG. 11.

Figure 14:
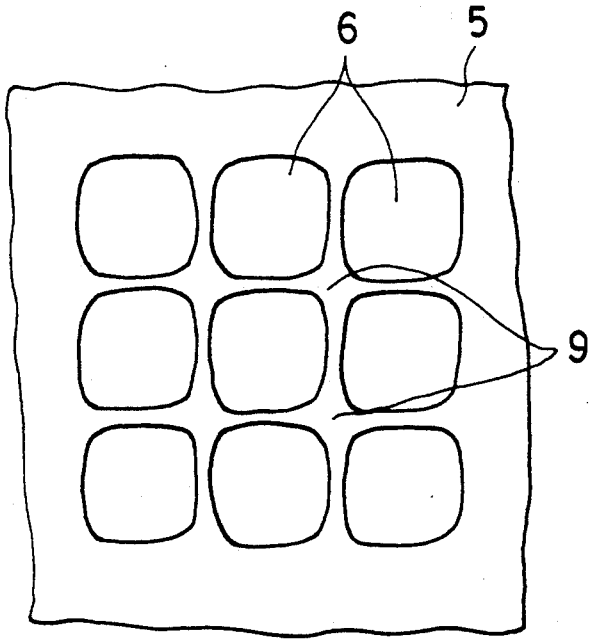
FIG. 14 is a plan view of a stencil produced by the plate making apparatus using the thermal head of FIG. 13.

In accordance with the embodiment of FIG. 13, not only is the heat concentrated to the narrowed center portion of the element so that the temperature of the element center is raised but also the four corners surrounding the center porion are highly heated by the triangular protruding portions 23 so that the temperature of each corner is also raised. As a result, each of the ink holes 6 made by heating the stencil paper 5 with the use of the thermal head 25 becomes substantially square, as illustrated in FIG. 14, which upgrades the printing quality of the print printed by the stencil 5.

It is to be noted that in any of the embodiments mentioned above, the scanning pitch of the stencil in the vertical scanning direction is arranged the same as the pitch of the dots (elements) in the horizontal scanning direction.

Figure 15:
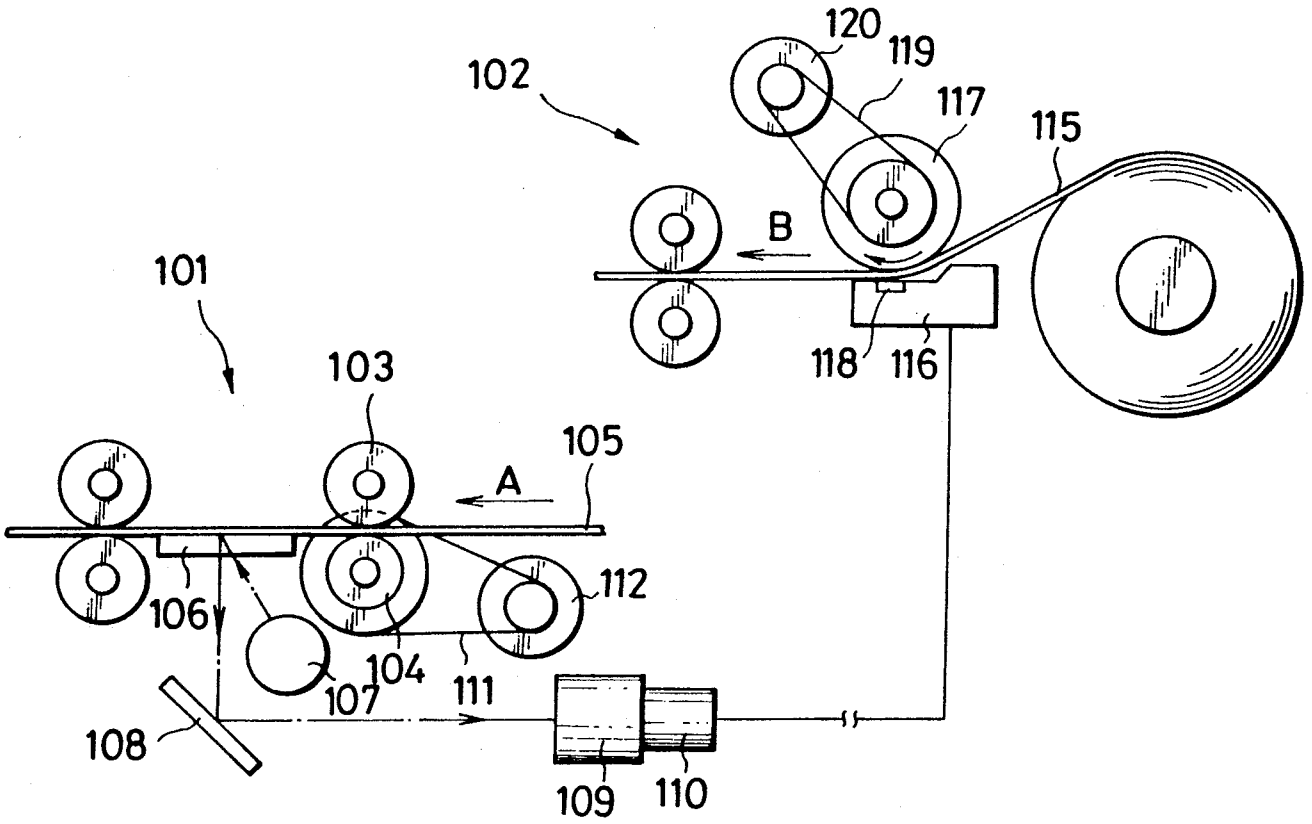
FIG. 15 is a constructional view of an example of the thermal plate making apparatus to which the present invention can be applied.

FIG. 15 illustrated another example of the thermal plate making apparatus using a thermal head.

The apparatus comprises essentially an original reading device 101 for obtaining a writing signal and a plate writing device 102 for making a stencil. First, in the device 101, an original 105 is conveyed in the vertical scanning direction indicated by an arrow A by a pair of conveyor rollers 103 and 104. The original 105 is conveyed over a contact glass 106 with the original side to the copied arranged as the lower side facing to the glass 106. The original 105 is irradiated by a fluorescent lamp 107 during passing over the glass 106. The reflection light reflected from the original 105 is deflected by a mirror 108 first and passes through a lens block 109 to a CCD line sensor 110 composed of photo-electric converter elements. The sensor 110 converts the optical information of the original image to an electric signal. The electric signal is transmitted to the device 102.

In the device 101, the sensor 110 reads the original image in one dimension, for example by an array sensor composed of sensing elements disposed in a line, along the horizontal scanning direction at a predetermined resolution. The original is conveyed in the vertical scanning direction so that the original is read in two dimensions.

The resolution of the sensor 110 to read the original is the same as the resolution of the thermal head to form holes in the stencil. That is, the sensing elements of the sensor 110 are disposed with the same density as the heating elements of the thermal head. The resolution is 16 dots per one mm, for instance.

The conveyor roller 104 is driven to rotate by a pulse motor 112 through a timing belt 111. The original 105 is conveyed intermittently, precisely speaking, by the roller 104. That is, the original 105 is advanced by one pitch in the vertical scanning direction when one line is scanned in the horizontal scanning direction. The scanning pitch of the intermittent advancing motion of the original in the vertical scanning direction is the same as that of the stencil to be produced by the plate making apparatus of the present invention.

On the other hand, in the side of the device 102, the stencil 115 is arranged in a roll style. The stencil is composed of a thermal plastic resin film and a porous back up film laminated together. The stencil 115 is conveyed between the head 116 and the platen 117 disposed in contact with the head 116. The platen 117 is driven to rotate to convey and advance the stencil 115.

The head 116 comprises a number of heating elements 118 facing the platen roller 117 and arranged in a line as one dimensional array in the horizontal scanning direction (perpendicular to the drawing). The stencil 115 is arranged so that the thermal plastic film side thereof comes in direct contact with the heating elements 118 of the head 116.

By applying current to the elements 118 selectively in accordance with the electric signal transmitted from the sensor 110 of the device 101, the film of the stencil is heated and melted by the energized elements so that holes are formed in the stencil to form dots for passing the printing ink therethrough.

The platen 117 is driven to rotate by a pulse motor 120 through a timing belt 119. Precisely speaking, the stencil 115 is conveyed intermittently with respect to the element 118 in the vertical scanning direction. That is, the stencil 115 is advanced by one pitch in the vertical scanning direction each time when one step for making holes in one line of horizontal scanning direction is finished.

The vertical scanning pitch $P_1$ of the stencil 115 is the same as the pitch of arrangement of the elements 118 (dot pitch) in the horizontal scanning direction. The pitch $P_1$ is also the same as the pitch $P_2$ of the intermittent original conveying motion mentioned before. For example, when the resolution is assumed to be 16 dots per one mm, it is arranged so that $P_1=P_2=62.5$ μm. This is for the sake of easy control of digital image processing at a high resolution.

In the event that the resolution is 16 dots per one mm, the elements 118 of the head 116 are arranged, for example, as illustrated in FIG. 1 mentioned before, in such a way that the pitch $P_M$ in the horizontal scanning direction is 62.5 μm and that each element is rectangular having length $l_s$ of 80 to 120 μm in the vertical scanning direction. The head 116 having the resolution and size mentioned above can be used as it is for the thermal head of a facsimile or a thermal printer. In FIG. 1, numerals 121 and 122 designate wiring patterns connecting to the element 118 at the both ends in the vertical scanning direction, respectively.

Figure 16:
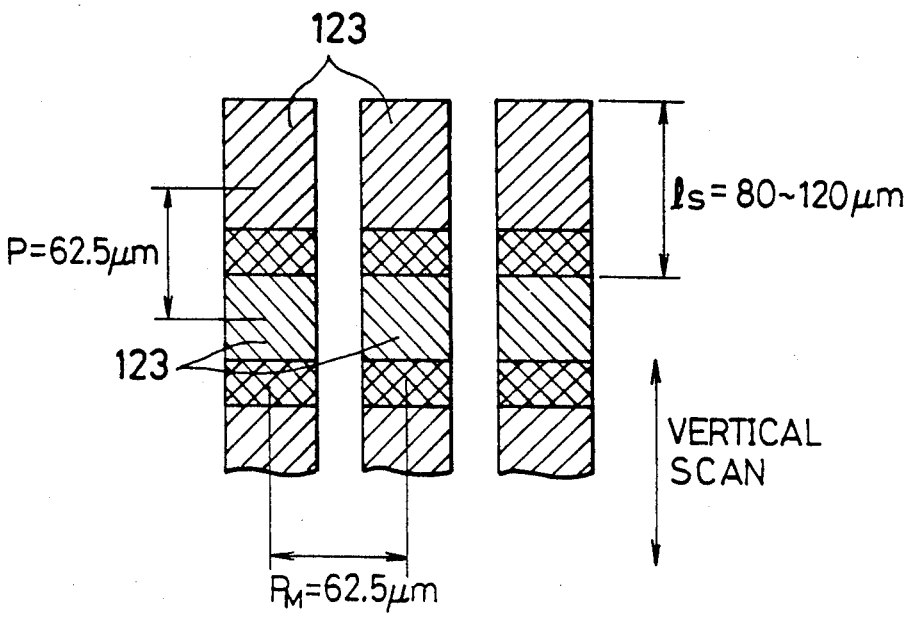
FIG. 16 is an explanatory view for explaining the heating area of the thermal head of the apparatus of FIG. 15 at the time of forming holes in the stencil paper.
Figure 17:
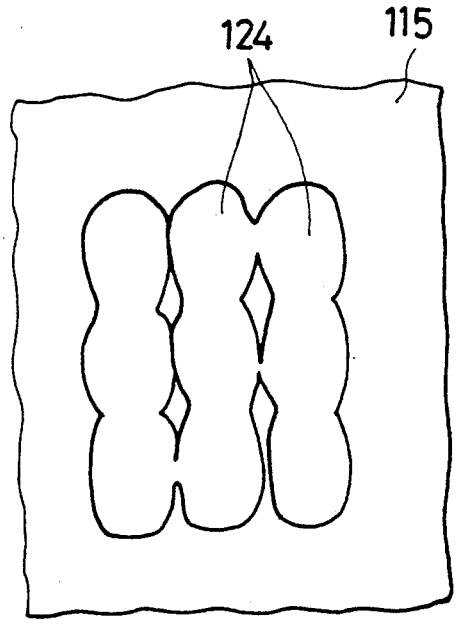
FIG. 17 is a plan view of the stencil produced by the thermal head of FIG. 16.

However, in accordance with the thermal head 116 having the dimensions as mentioned above, when the stencil 115 is conveyed with the pitch $P_1$ of 62.5 μm, the heating area 123 of each element becomes overlapped in the vertical scanning direction, as illustrated in FIG. 16, so that the heating areas become continuous. As a result, the holes 124 formed in the stencil 115 become continuous in the vertical scanning direction instead of being formed as independent holes, as illustrated in FIG. 17.

If such a stencil 115 is used for printing, an overly large amount of ink is transferred to the paper through the enlarged continuous holes 124, which stains the back side of the subsequent printed paper stacked on the paper now printed.

To avoid this problem, the structure of FIG. 3 mentioned before is adopted. In accordance with this FIG. 3 structure, the thermal head 125 is arranged in such a manner that the length $l_s$ of the element 118 in the vertical scanning direction is shorter than the pitch $P_M$ of the elements in the horizontal scanning direction. For example, when the resolution is 16 dots per one mm, it is arranged so that $P_M=62.5$ μm and $l_s=60$ μm, respectively.

With the use of such a thermal head 125, it becomes possible to form independent holes 126 for respective dots in the stencil 115, as illustrated in FIG. 4. As a result, an adequate amount of ink is transferred through the holes 126 so that it becomes possible to attenuate the problem of staining the back side of the stacked printed paper.

However, when the length of the heating element in the vertical scanning direction is decreased, the life of the thermal head becomes short. Also, unevenness of the temperature distribution for each element 118 becomes large as well as the unevenness of the size of the holes 126 formed in the stencil 115. This problem is further described with reference back to FIG. 5 below.

In FIG. 5, the abscissa represents the position in the element along the vertical scanning direction and the ordinate represents the temperature at the position.

First, with regard to the long heating element 118, as illustrated in FIG. 1, having the length $l_s$ of 85 to 120 μm along the vertical scanning direction, the temperature distribution is represented by dash lines (a). The distribution curve changes according to the unevenness of the element resistance due to the head structure and the unevenness of the applied energy. The curve changes within a range between a minimum distribution curve $a_1$ and a maximum distribution curve $a_2$. The temperature $t_0$ represents the critical temperature for making holes in the stencil.

On the other hand, with regard to the short element of the head 125 of FIG. 3 having the length of 60 μm along the vertical scanning direction, the temperature distribution is represented by dash-dot lines (b). The maximum distribution is represented by tha upper curve $b_2$ and the minimum distribution is represented by the lower curve $b_1$, respectively.

That is, when the element is shortened, the distribution curve becomes steep and the changing range of the distribution becomes wide (as represented by the range between $b_1$ and $b_2$). This means that by shortening the element, the peak temperature is raised to increase the thermal stress in the element, which promotes the oxidation of the element and impairs the quality thereof. The higher the peak temperature becomes, the more rapidly the element is oxidized. If the element is oxidized, the resistance thereof increases and eventually the element is damaged unusably.

The resistance of the thermal head changes due to the unevenness of element size in the vertical scanning direction caused by etching conditions. Therefore, if the element is short, the unevenness of the length influences more largely to the resistance of the head than when the element is long. When the unevenness of the resistance becomes large, the energy control for forming desired holes in the stencil becomes difficult, which results in that uneven holes are formed so that the printing quality is degraded, generating partly dark portions and partly thin portions in the print.

To obviate the above-mentioned problems, in accordance with an embodiment of the present invention, the thermal plate making apparatus is constituted in such a manner that the apparatus comprises a thermal head comprising a number of heating elements disposed in a line of one dimensional array along the horizontal scanning direction and a platen roller which urges a thermal stencil film to the head and that the stencil is conveyed at a predetermined pitch in the vertical scanning direction by the platen roller so that dot like holes are formed in the stencil by heating and melting the stencil by the thermal head, wherein the length of each element along the vertical scanning direction is longer than the pitch of the elements along the horizontal scanning direction and wherein the pitch of the advance motion of the stencil in the vertical scanning direction is equal to or slightly larger than the length of the element along the vertical scanning direction.

In accordance with the apparatus structure mentioned above, the length of the element along the vertical scanning direction is larger than the pitch of the elements arranged in a line along the horizontal scanning direction. Therefore, the life of the thermal head is elongated and the unevenness of the temperature distribution between the elements is minimized.

Also, the pitch of the intermittent advancing motion of the stencil is arranged larger than the length of the element along the vertical scanning direction, which makes it possible to avoid overlapping of the dots formed in the stencil in the vertical scanning direction so that the dots are disposed independently from each other, whereby upgrading the printing quality.

The embodiment of the present invention is further described hereinafter with reference to FIGS. 18 and 19.

In this particular embodiment, the apparatus is arranged under such conditions that the resolution is 16 dots per one mm, that the pitch $P_M$ of the elements 118 in the horizontal scanning direction is 62.5 μm, that the length $l_s$ of the element along the vertical scanning direction is 80 μm which is larger than $P_M$, and that the scanning pitch $P_1$ is 85 μm which is equal to $P_2$ and not less than $l_s$.

Figure 18:
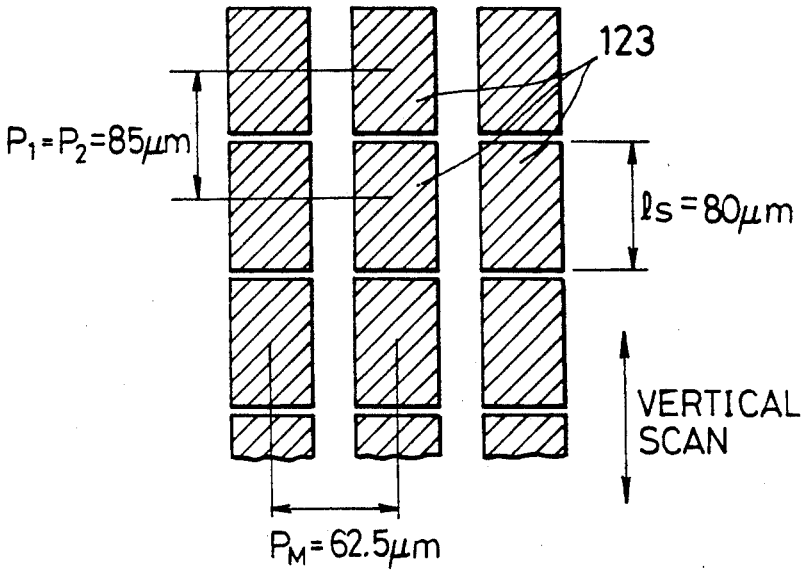
FIG. 18 is a plan view of the line thermal head in accordance with the present invention.
Figure 19:
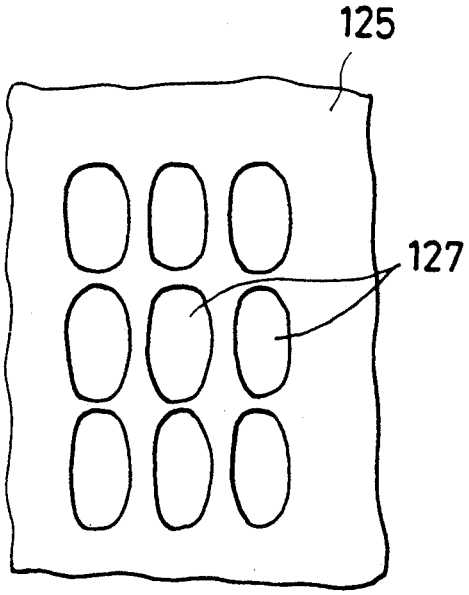
FIG. 19 is a plan view of a stencil produced by the thermal plate making apparatus using the thermal head of FIG. 18.

By forming the ink holes (dots) in the stencil film on the conditions mentioned above, the heating areas 123 do not overlap with each other in the vertical scanning direction, as illustrated in FIG. 18. Accordingly, as illustrated in FIG. 19, the holes (dots) 127 formed in the stencil 125 are independently disposed without becoming continuous together in the vertical scanning direction.

The numerical conditions are not limited to those exemplified above but may be desirably determined in response to the energy to be applied and the thermal sensitivity of the plastic film of the stencil 115, etc. The scanning pitches $P_1$ and $P_2$ are arranged to be equal to or slightly larger than (1.0 to 1.3 times as) the length $l_s$ of the element 118. For example, when $l_s=80$ μm, it is arranged as $P_1=P_2=80-100$ μm, while when $l_s=70$ μm, it is arranged as $P_1=P_2=70-90$ μm.

Also, in accordance with the thermal head of the present invention, since the length $l_s$ of the element along the vertical scanning direction is not short, it becomes possible to avoid shortening of the life and increasing unevenness of the temperature distribution in the element.

It is to be noted that in accordance with the embodiment of the present invention mentioned above, the image formed in the stencil 115 has different resolutions in the horizontal scanning direction and the vertical scanning direction, respectively. Concretely, as can be seen from FIG. 19, the resolution (density of dots) in the vertical scanning direction is lowered in comparison to that of the horizontal scanning direction. However, such a difference between the resolutions in the two directions does not practically impair the pint quality. That is, the image is printed from the stencil 115 to a print paper by passing the ink through the holes 127 formed in the stencil 115, wherein the blot around the holes impairs the print quality. In that circumstance, an image of the resolution of 16 dots per one mm is substantially the same as that of 12 dots per one mm on the printed paper. Suppose that the resolution in the horizontal scanning direction is 16 dots per one mm and the scanning pitch of the advance motion, the resolution in the horizontal scanning direction is calculated to be substantially equivalent to 12 dots per one mm.

In accordance with the apparatus structure mentioned above, the length of the element along the vertical scanning direction is larger than the pitch of the elements arranged in a line along the horizontal scanning direction. Therefore, the life of the thermal head is elongated and the unevenness of the temperature distribution between the elements is minimized.

Also, the pitch of the intermittent advancing motion of the stencil is arranged larger than the length of the element along the vertical scanning direction, which makes it possible to avoid overlapping of the dots formed in the stencil in the vertical scanning directions so that the dots are reliably disposed independently from each other, whereby upgrading the printing quality without staining the back side of the printed paper when stacked.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal plate making apparatus for forming a thermal stencil through which ink passes via holes in said stencil, the stencil advanced intermittently so as to be fed a predetermined distance a time, said apparatus comprising:

a thermal head including a plurality of planar heating elements arranged side-by-side in a direction perpendicular to an advancing direction of the thermal stencil, wherein in a plane which extends parallel to the planar heating elements, each of said planar heating elements has a pair of parallel opposite sides separated from each other in a direction perpendicular to the direction of stencil advancement, and top and bottom portions separated from each other in the direction of stencil advancement, said top and bottom portions being substantially V-shaped portions which protrude inwardly toward a center of each of the planar heating elements.

2. A thermal plate making apparatus for forming a thermal stencil through which ink passes via holes in said stencil, the stencil being advanced intermittently so as to be fed a predetermined distance at a time, said apparatus comprising:

a thermal head including a plurality of planar heating elements arranged side-by-side in a direction perpendicular to an advancing direction of said thermal stencil, wherein in a plane which extends parallel to the planar heating elements, each of said planar heating elements has substantially parallel top and bottom sides separated from each other in said direction of stencil advancement, and opposite side portions are parallel to each other and separated in a direction perpendicular to the direction of stencil advancement, said side portions having rectangular cut-out notches formed at a center portion thereof extending inwardly toward a center of each of the planar heating elements.

3. The thermal plate making apparatus according to claim 1, wherein said parallel opposite sides of the planar heating elements have cut-out notches formed at a center portion thereof extending inwardly toward a center of each of the planar heating elements.

4. The thermal plate making apparatus according to claim 1 or 3, wherein a length of each of said planar heating elements in the direction of stencil advancement is greater than a pitch of said heating elements, said pitch being a distance in the direction perpendicular to stencil advancement from a center of one heating element to a center of an adjacent heating element, and said length of each heating element in the direction of stencil advancement is equal to or less than said pitch.

5. The thermal plate making apparatus according to claim 1 or 3, wherein a length of each heating element, taken in the direction of stencil advancement, is greater than a width of the heating element taken in the direction perpendicular to stencil advancement.

* * * * *